US006729217B2

(12) United States Patent
Loewensberg

(10) Patent No.: US 6,729,217 B2
(45) Date of Patent: May 4, 2004

(54) DEVICE FOR BREAKING NICKS CONNECTING TWO EDGES OF A CUTTING LINE

(75) Inventor: Denis Loewensberg, Aigle (CH)

(73) Assignee: Bobst S.A. (CH)

( * ) Notice: Subject to any disclaimer, the term of this patent is extended or adjusted under 35 U.S.C. 154(b) by 13 days.

(21) Appl. No.: 09/816,808

(22) Filed: Mar. 23, 2001

(65) Prior Publication Data

US 2001/0025868 A1 Oct. 4, 2001

(30) Foreign Application Priority Data

Mar. 30, 2000 (CH) ..... 0614/00

(51) Int. Cl.[7] ..... B31B 13/14

(52) U.S. Cl. ..... 83/332; 83/497; 83/508.2; 493/473

(58) Field of Search ..... 493/471, 473; 83/82, 879, 883, 884, 885, 886, 887, 651, 663, 664, 665, 673, 677, 332, 698.51, 698.61, 666, 497, 508.2; 225/93, 96.5, 97, 103, 104

(56) References Cited

U.S. PATENT DOCUMENTS

| | | | | | |
|---|---|---|---|---|---|
| 1,268,394 | A | * | 6/1918 | Shamblen | 241/277 |
| 1,473,377 | A | * | 11/1923 | Langston | 83/103 |
| 1,730,006 | A | * | 10/1929 | Harrold | 83/664 |
| 2,598,649 | A | * | 5/1952 | Taylor | 493/60 |
| 3,518,922 | A | | 7/1970 | Kuehn | |
| 3,575,091 | A | | 4/1971 | Labantschnig | |
| 3,850,069 | A | * | 11/1974 | Saunders | 83/665 |
| 3,899,948 | A | * | 8/1975 | Jakob | 83/497 |
| 3,951,024 | A | * | 4/1976 | Weiskopf | 83/498 |
| 4,019,428 | A | | 4/1977 | Grobman | |
| 4,254,680 | A | * | 3/1981 | Gauthier | 403/5 |
| 4,725,261 | A | * | 2/1988 | Millard et al. | 493/342 |
| 4,776,249 | A | * | 10/1988 | Barclay | 241/DIG. 31 |
| 4,805,502 | A | * | 2/1989 | Ishigure | 83/332 |
| 4,881,436 | A | * | 11/1989 | Rommel | 83/342 |
| 4,932,298 | A | * | 6/1990 | Capdebosco | 83/332 |
| 5,045,045 | A | * | 9/1991 | Davenport et al. | 101/224 |
| 5,049,121 | A | * | 9/1991 | Bunch, III | 493/357 |
| 5,144,874 | A | * | 9/1992 | Garrett | 83/332 |
| 5,297,462 | A | * | 3/1994 | Creaden | 83/305 |
| 5,367,928 | A | * | 11/1994 | Geiser et al. | 83/13 |
| RE35,086 | E | * | 11/1995 | Paulson et al. | 83/13 |
| 5,522,441 | A | * | 6/1996 | Anselm et al. | 142/41 |
| 5,580,010 | A | * | 12/1996 | Barclay et al. | 241/236 |
| 5,644,940 | A | * | 7/1997 | Chubb et al. | 72/197 |
| 6,159,137 | A | * | 12/2000 | Lee et al. | 493/151 |
| 6,231,492 | B1 | * | 5/2001 | Graag | 493/368 |

FOREIGN PATENT DOCUMENTS

| | | | |
|---|---|---|---|
| EP | 0680821 | 11/1995 | 1/74 |

* cited by examiner

*Primary Examiner*—Rinaldi I. Rada
*Assistant Examiner*—Gloria R Weeks
(74) *Attorney, Agent, or Firm*—Ostrolenk, Faber, Gerb & Soffen, LLP

(57) ABSTRACT

This device comprises a frame carrying means for conveying blanks according to a substantially plane path and two parallel shafts (10, 11), which are mounted so as to be rotatable on both sides of the plane of said path and comprising tool supports (19*a,* 19*b,* 20*a,* 20*b*) for inducing a shearing between the adjacent edges of a cutting line during their displacement, in order to break nicks on the cutting line. Each parallel shaft (10, 11) comprises at least one tool support (19*a,* 19*b,* 20*a,* 20*b*) for connecting the shearing tools to said respective shafts (10, 11) and means for angularly (10*a,* 11*a*) and longitudinally positioning these tool supports (19*a,* 19*b,* 20*a,* 20*b*) on said respective shafts (10, 11).

10 Claims, 7 Drawing Sheets

DEVICE FOR BREAKING NICKS CONNECTING TWO EDGES OF A CUTTING LINE

BACKGROUND OF THE INVENTION

The present invention relates to a device for breaking nicks connecting two edges of a cutting line which is provided on blanks of cardboard before folding them, comprising a frame carrying means for conveying the blanks along a path substantially planar and two parallel shafts, rotatably mounted on both sides of the plane of the path, comprising tools for inducing a shearing between the edges adjacent to the cutting line, during their displacement, in order to break the nicks.

When cutting certain cardboard blanks to be folded according to folding lines, to form boxes in particular, it is often useful or even necessary, to maintain a connection between the adjacent edges of at least some cutting lines, in order to avoid that the blanks cling to one another. Generally, these are punctual connections between the edges of the cutting line and spaced from one another along the cutting line.

When introducing such blanks into a folder-gluer, these connections must be broken before performing the folding operations of these blanks.

A device has already been proposed, for example, in patent EP 0 680 821. This device is more particularly intended to break the fibers of cardboard which can accidentally remain in blanks from which the various panels are separated by simple cutting lines. Even if the reasons of the connections are involuntary here, the problem to be solved is, however, completely comparable with that evoked above.

The solution suggested by the above-mentioned document has a plurality of disadvantages, primarily related to its lack of flexibility, the tools for inducing the shearing in order to break uncut fibres being directly formed on the rotary shafts. Therefore, the change of the type of cardboard blanks requires the change of the two shafts, involving a significant disassembling operation of the device. Moreover, the swivel pins of these shafts on the frame being fixed, such a device can only be used for a same type of box, in this case cigarette packagings, so that this device is not usable to process cardboard blanks of substantially different sizes.

Another disadvantage, related to this solution of prior art, lies in the fact that the cardboard blanks must be spaced from one another with very precise spacings, or else, if the relative position of the tools and blanks varies, there will be a shift between the tools and the parts of the cardboard blanks to be worked, making it impossible to achieve the goal required and being likely to damage the cardboard blanks. However, the keeping of this precise spacing requires adjustment operations which are long and meticulous so that the productivity is limited, owing to the fact that the number of blanks processed per unit of length cannot be optimized.

SUMMARY OF THE INVENTION

The aim of the present invention is to meet, at least partly, the difficulties of the above-mentioned device.

To this end, this invention is directed to a device which comprises a frame, a conveyor supported by the frame for conveying cardboard blanks along a path that is substantially planar, first and second parallel shafts rotatably mounted to the frame and disposed on both sides of the substantially planar path of the blanks, first and second annular tool supports respectively disposed on the first and second shafts, a mechanism operative to move the tool supports both rotatively and linearly on the first and second shafts to position the tool supports both angularly and longitudinally on the respective shafts, first and second shearing tools respectively supported on the tool supports, whereby the shearing tools are rotatable with the respective shafts, and a drive mechanism for rotating the shafts and the tools thereon.

The design of this device allows a great flexibility of use and an adaptation to cardboard blanks of sizes likely to vary in significant proportions. This new design also facilitates the adjustment of the position of the tools, thus increases the productivity.

Numerous other particularities and significant advantages of this device will become evident from the following description and from the enclosed drawings which illustrate, schematically and by way of example, an embodiment of the device for breaking the nicks connecting two edges of a cutting line, object of the present invention.

DESCRIPTION OF A PREFERRED EMBODIMENT

Figure 1:
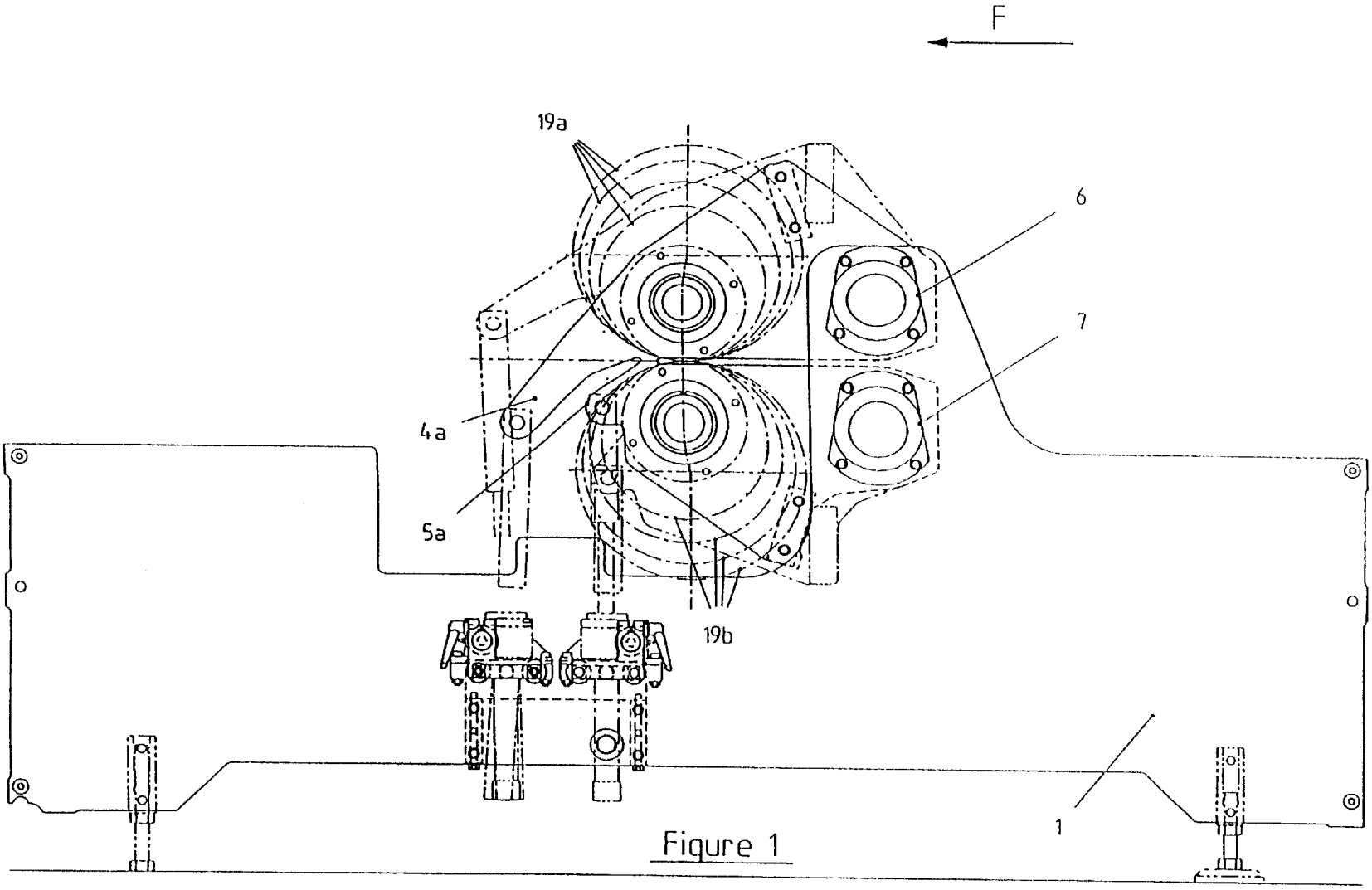
FIG. 1 is a front view of this embodiment, seen from the left side with respect to the travelling direction of the cardboard blanks.
Figure 1A:
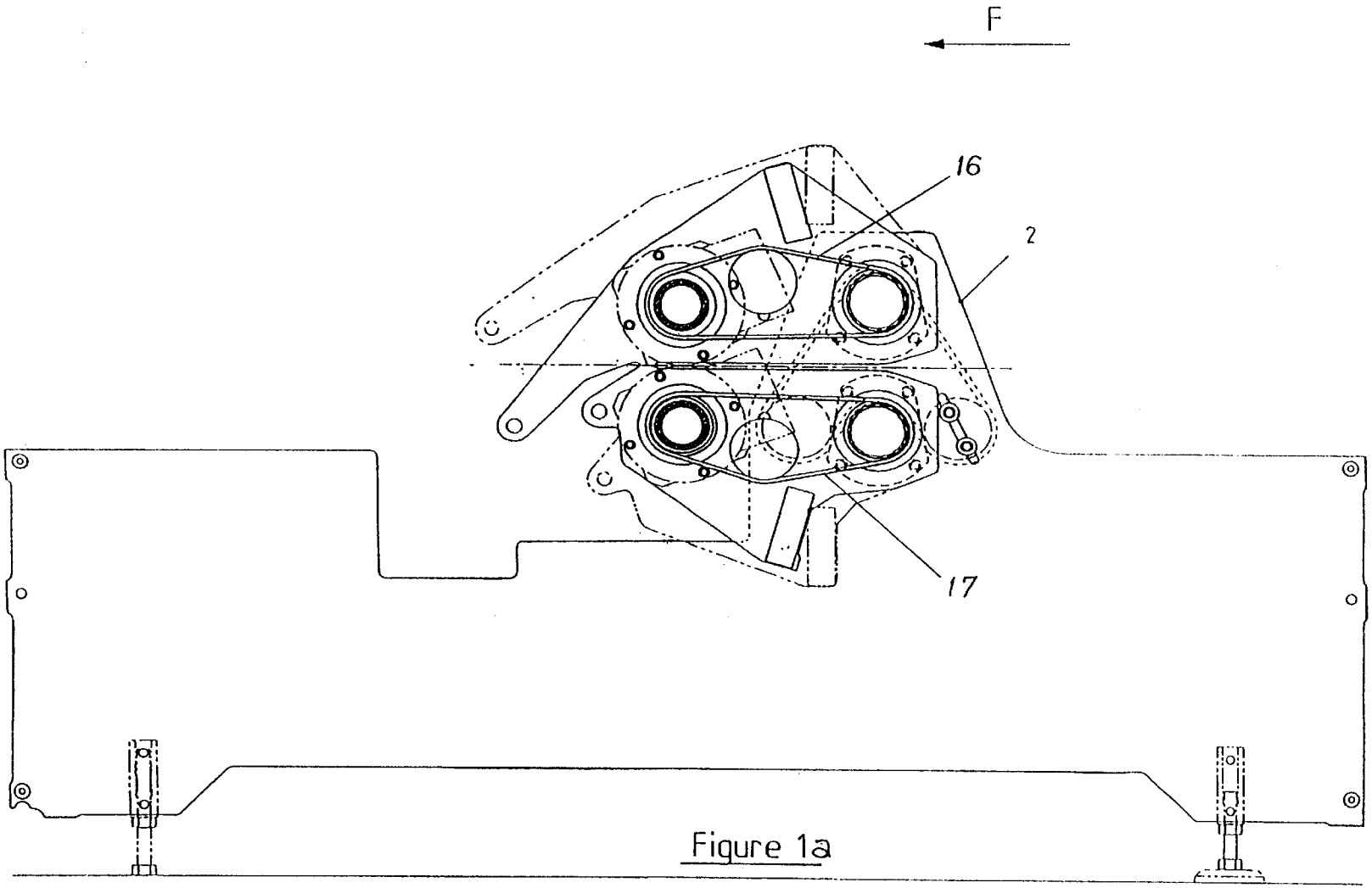
FIG. 1*a* is a front view of this embodiment, seen from the interior right side with respect to the travelling direction of the cardboard blanks.

Hereinafter in the description, when referring to the left side and the right side of the device, it is relative to the travelling direction of the cardboard blanks, shown by an arrow F. The device illustrated by FIGS. 1–3 comprises a frame primarily formed of two vertical parts, left and right, respectively 1 and 2, maintained spaced from one another by a plurality of spacers 3.

Two cradles, an upper cradle 4*a* and a lower cradle 5*a,* are secured to the left part 1 of the frame and two other cradles, an upper cradle 4*b* and a lower cradle 5*b* are secured to the right part 2 of the frame. Each cradle 4*a,* 5*a,* is pivotally mounted on the left part 1 of the frame by a swivel pin 6, respectively 7. Each cradle 4*b,* 5*b,* is pivotally mounted on the right part 2 of the frame by a swivel pin 8, respectively 9. The two upper cradles 4*a,* 4*b* carry a first tool holder shaft 10, whereas the two lower cradles 5*a,* 5*b* carry a second tool holder shaft 11.

The two upper cradles 4*a,* 4*b* are secured to an adjusting device 12 with endless screw, acting on two rods 12*a,* 12*b* connected to the ends of the respective cradles 4*a,* 4*b* opposite to the swivel pins 6, 8 for pivoting these upper cradles 4*a,* 4*b* about these swivel pins 6, 8. Another similar adjusting device 13 allows to pivot the lower cradles 5*a,* 5*b* about swivel pins 7, 9, by means of two rods 13*a,* 13*b.*

Figure 2:
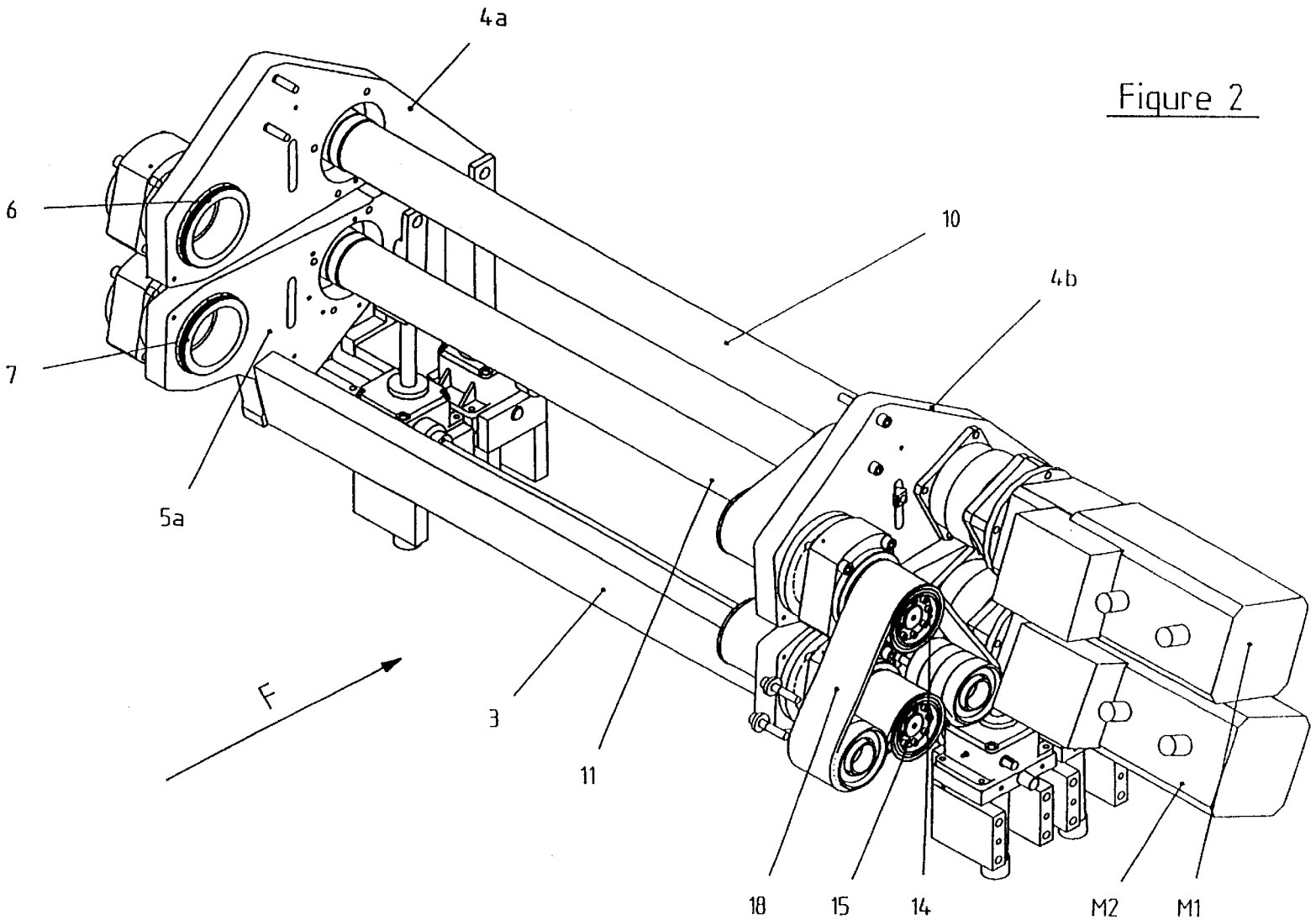
FIG. 2 is a perspective view from the other side of the device.

Each tool holder shaft 10, 11 is fixedly attached to a synchronous drive motor M1, respectively M2. The tool holder shafts 10, 11 are kinematically connected to shafts 14, respectively 15, coaxial to the swivel pins 8, 9 of the cradles 4*b,* 5*b,* by toothed belts 16, respectively 17. The shafts 14, 15 cross the right part 2 of the frame, as can be seen in FIG. 2, and extend on the two sides of this right part 2.

The external portions of the shafts 14, 15 are kinematically connected by a belt 18 toothed on its two faces, so that the angular positions of the two tool holder shafts 10, 11 are constantly synchronous. To obtain this result, one of the motors M1, M2 must be controlled by the other one. In this example, it is the motor M1 which is controlled by the motor M2. The control device will be described in relation to FIG. 6.

Each tool holder shaft 10, 11 is provided with a keyslot 10*a,* 11*a* for the angular positioning of supports of annular tools 19*a,* 19*b,* 20*a,* 20*b.* These tool supports always go per pair and face one another, the tools of a tool support 19*a* fixedly attached to the upper tool holder shaft 10 co-operate with the tools of the tool support 19*b* fixedly attached to the lower tool holder shaft 11.

Figure 4:
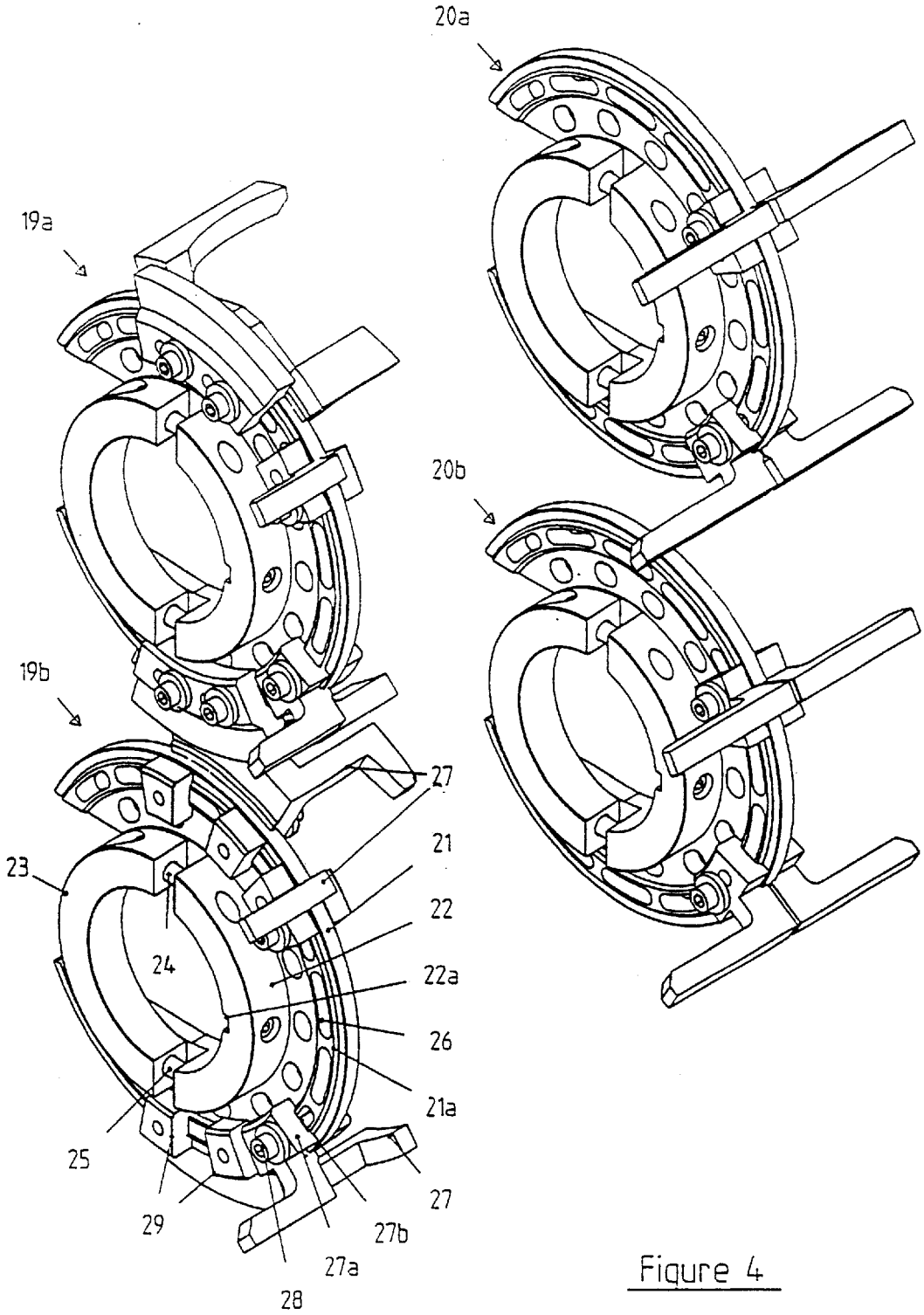
FIG. 4 is an enlarged perspective view of a detail in FIG. 2.

These annular tool supports 19*a,* 19*b,* 20*a,* 20*b* are illustrated on a large scale by FIG. 4. Only one, 19*b,* will be described here in detail, insofar as they all are identical. This tool support 19*b* comprises a discoidal ring 21 in the form of a sector of a circle, whose angular opening is dimensioned to allow the passage of one of the tool holder shafts 10, 11. The discoidal rings 21 of two tool supports 19*a,* 19*b* of a same pair are coplanar, i.e. they are positioned to occupy the same axial positions along their respective tool holder shafts 10, 11.

The discoidal ring 21 is fixedly attached to a first half clamping collar 22 of a diameter corresponding to that of said tool holder shafts 10, 11, provided with an internal groove 22*a* cooperating with one of the keyslots 10*a,* 11*a* of the tool holder shafts 10, 11. A second half clamping collar 23 of a diameter corresponding to that of said tool holder shafts 10, 11, connected to the first half clamping collar 22 by two tightening screws 24, 25, allows to axially lock the tool support 19*b* along the tool holder shaft 11 by tightening this shaft between the two half clamping collars 22, 23.

The discoidal ring 21 comprises an annular positioning projection 21*a,* provided with a plurality of openings in arc of a circle 26 coaxial to the discoidal ring 21. A similar annular positioning projection of the same diameter as the projection 21*a* (not shown) is provided on the other face of the discoidal ring 21. Various tools 27 for breaking the nicks connecting two edges of a cutting line of a cardboard blank are positioned angularly along these annular projections owing to positioning shoes 27*a* in which is provided a positioning groove 27*b* coming into engagement with the annular projection 21*a.*

These tools 27 are fixed along the annular projections 21*a* by fastening bolts 28 which extend through the positioning shoes 27*a* and the openings in arc of a circle 26 so as to be screwed in nuts 29, engaged with the annular projection provided on the opposite face of the discoidal ring 21.

As can be seen in FIG. 4, a part of the tools 27 extends from a side of the median plane of the discoidal ring 21, whereas the other part of these tools extends from the other side of this same median plane. Therefore, the tools 27 of two tool supports 19*a,* 19*b* of a same pair of tool supports which extend from a side of this median plane and those which extend from the other side of this median plane describe two circular parallel and adjacent trajectories, since the discoidal rings 21 of the two tool supports 19*a,* 19*b* are coplanar.

It can also be observed that the peripheral edges of certain of these tools 27 describe circular trajectories of larger diameters than the peripheral edges of the other tools 27. The trajectories of smaller diameter of the peripheral edges of the tools 27 are chosen to be substantially tangent with the plane trajectories of the blanks moved by the conveying device which will be described thereafter, so that these tools 27 act as support of the blanks. The peripheral edges of the other tools 27, whose trajectories are of larger diameters, are adjusted to penetrate in the plane path of the cardboard blanks conveyed by the conveyor.

Therefore, when a cutting line, provided in a cardboard blank, passes between these tools 27, parallel to the coplanar median plane of the discoidal rings 21 of the tool supports 19*a,* 19*b,* the two edges of the cutting line of this cardboard blank are subject to a shearing which break the nicks connecting these two edges to one another, since one tool 27, describing a circular path extending from a side of the median plane of the discoidal rings 21, cut the plane path of the blanks, whereas the other tool 27, describing a circular parallel and adjacent path extending from the other side of this median plane, is substantially tangent to the plane path of the cardboard blanks.

The conveying mechanism which will now be described is arranged between the left 1 and right 2 parts of the frame. As the situation of this mechanism would not make it easily visible, it is separately represented to facilitate the reading of the drawing. It presents a lower part 30 and two upper parts 31*a,* 31*b.* The lower part comprises an endless conveying belt 32 guided by a plurality of rollers 33 and driven by a motor 34. A part of the rollers 33 are arranged in a plane corresponding to the conveying path of the cardboard blanks.

Figure 5:
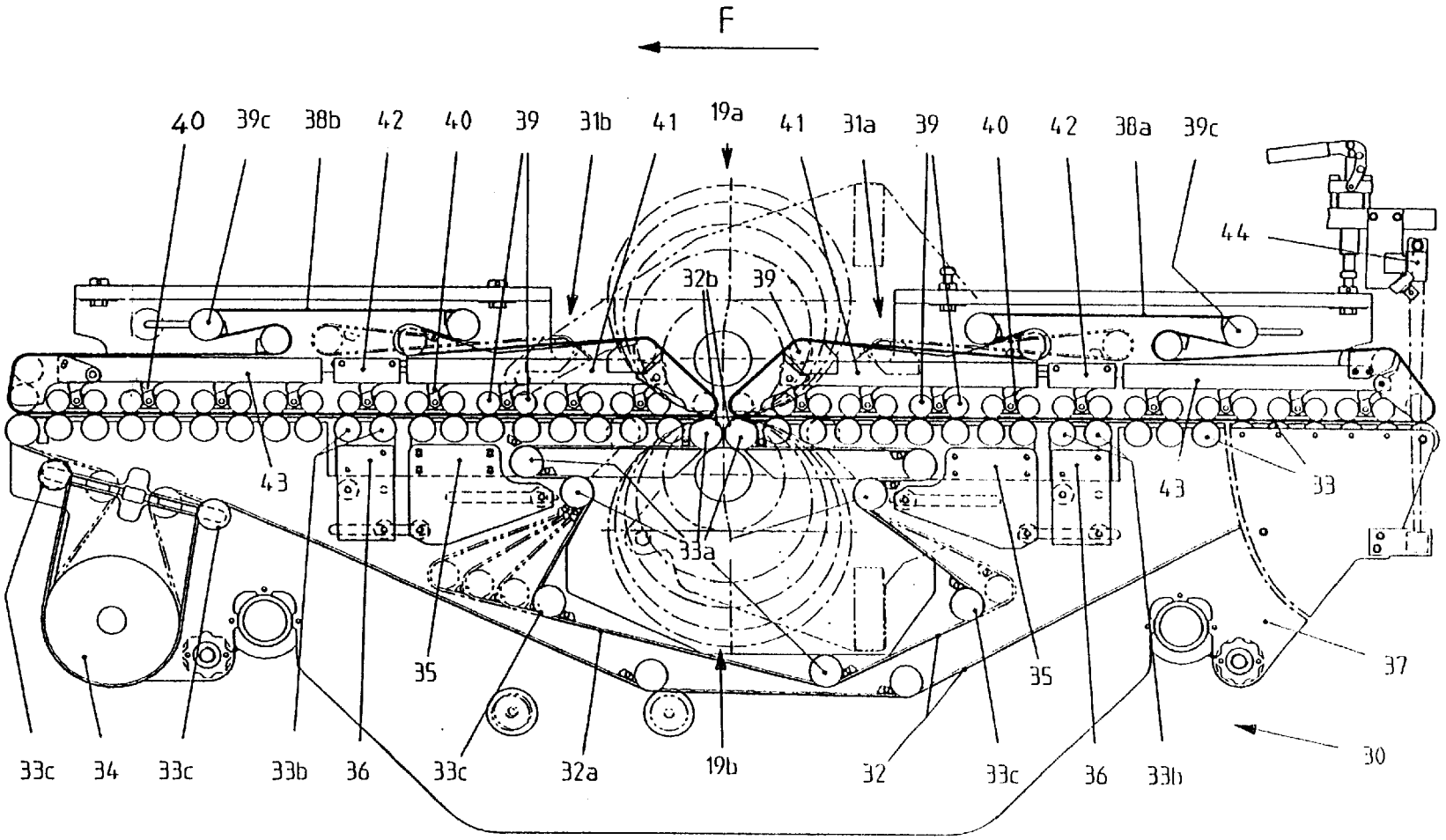
FIG. 5 is a lateral front view from the left side of the single conveying mechanism of this embodiment.

In the center of the conveying plane formed by rollers 33, the endless conveying belt 32 is guided by a series of rollers 33*a,* to form a loop 32*a* extending below the plane of the conveying path. This loop 32*a* provides a space corresponding to the requirement of the tool support 19*b* carried by the lower tool holder shaft 11. On FIG. 5, the loop 32*a* is represented closed, its two ends 32*b* substantially meeting at the tangent point of the conveying belt 32 with the circular path of the tool support 19*b.*

On each side of this tangent point, the rollers 33 of the conveyor defining the lower part of the horizontal conveyor mechanism, divides symmetrically with respect to this tangent point, in three sections, a section in which the rollers 33 are mounted on a slide 35, followed by a section comprising, in this example, two rollers 33*b* fixedly attached to a removable support 36 and finally a section where the rollers 33 are directly mounted on the frame 37 of the conveying mechanism 30. Some guide rollers 33 of the conveying belt 32 also act as idler rollers 33*c,* mounted on movable supports (not shown), stressed by mechanical means (not shown) which constantly maintain the conveying belt tight. The adjustment of the opening and the closing of the loop 32*a* of the conveying belt 32 will be explained thereafter.

The two upper parts 31*a,* 31*b* of the conveying mechanism are arranged in mirror symmetry with respect to the axis connecting the centers of the two tool holder shafts 19*a,* 19*b.* These two parts 31*a,* 31*b* being similar, only one of them will be described. Each part 31*a,* 31*b* presents an endless conveying belt 38*a,* 38*b* guided by rollers 39, of which a part forms a plane surface parallel and adjacent to the plane part formed by the rollers 33 of the lower part 30 of the conveyor. Apart from rollers 39 forming the plane surface, certain rollers also act as idler rollers 39*c,* like the rollers 33*c* of the lower part 30 of the conveying mechanism.

The rollers 39 forming the plane conveying parts are grouped in a plurality of bogies 40 subjected to elastic pressure means (not shown), in order to press the conveying belts 32, on the one hand, and 38*a,* 38*b,* on the other hand, one against the other. A first part of these bogies 40 are articulated around horizontal axes which are parallel to the axes of the rollers 39 on a slide 41. The following bogie is fixedly attached to a removable support 42. Finally, the following bogies 40 are fixedly attached to a fixed support 43. A photocell 44 is arranged at the input of the conveying device for detecting the front edge of each cardboard blank arriving in the device for breaking the nicks.

Figure 6:
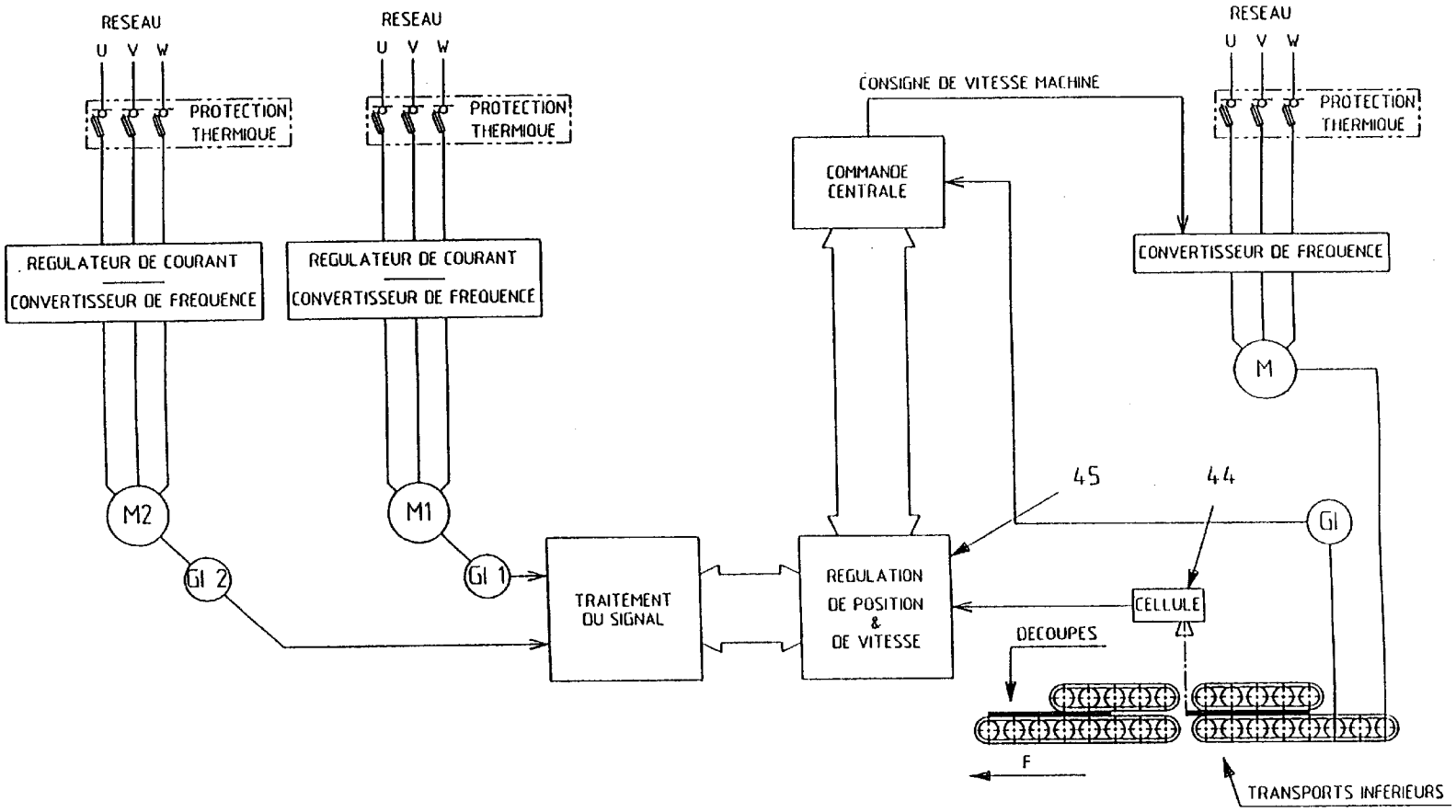
FIG. 6 is a block diagram of a control of the angular position of the tools with respect to the position of the blanks upstream of the working tools.

As soon as the front edge of a cardboard blank is detected by the cell 44, the exact distance separating this front edge from the tools 27 for breaking the nicks, between which the cardboard blank must pass, is known. This cell 44 generates a signal which is sent to a microprocessor 45 for regulation of the angular position of the tool holder shafts 19*a,* 19*b* by adjusting the speed of the drive motors M1, M2 (FIG. 6).

This angular position of the tool holder shafts 19*a,* 19*b* is constantly known owing to two pulse generators G1, G2 secured to the respective synchronous drive motors M1, M2 and transmitting their information to the microprocessor 45. Thus, when the front edge of a blank is detected, the microprocessor 45 knows the angular position of the tools 27 on the tool supports 19*a,* 19*b,* 20*a,* 20*b* mounted on the tool holder shafts 10 and 11. It also knows the distance between the front edge of the blank and the line joining the axes of the tool holder shafts 10, 11. It can then determine the angular correction to be applied. The microprocessor 45 carries out this correction by calculating, starting from the data collected, an acceleration or a deceleration, as well as a duration during which this correction must be applied to the synchronous drive motors M1, M2, so that tools 27 are in the desired angular position for breaking the nicks at the determined place of the cardboard blank.

The operation and the use of the described device are as follows:

When the device for breaking the nicks connecting two edges of a cutting line is used for a new type of cardboard blanks, the first work is to choose the tool supports 19*a,* 19*b,* 20*a,* 20*b* according to the size of the blank. The peripheral length of the tool support should correspond to the length of the blank measured in its travelling direction F, to which a certain length corresponding to an average spacing between the blanks is added, the precise adjustment being performed by the microprocessor 45 (FIG. 6), further to the detection of the front edge of each blank by the cell 44, as explained above.

Figure 3:
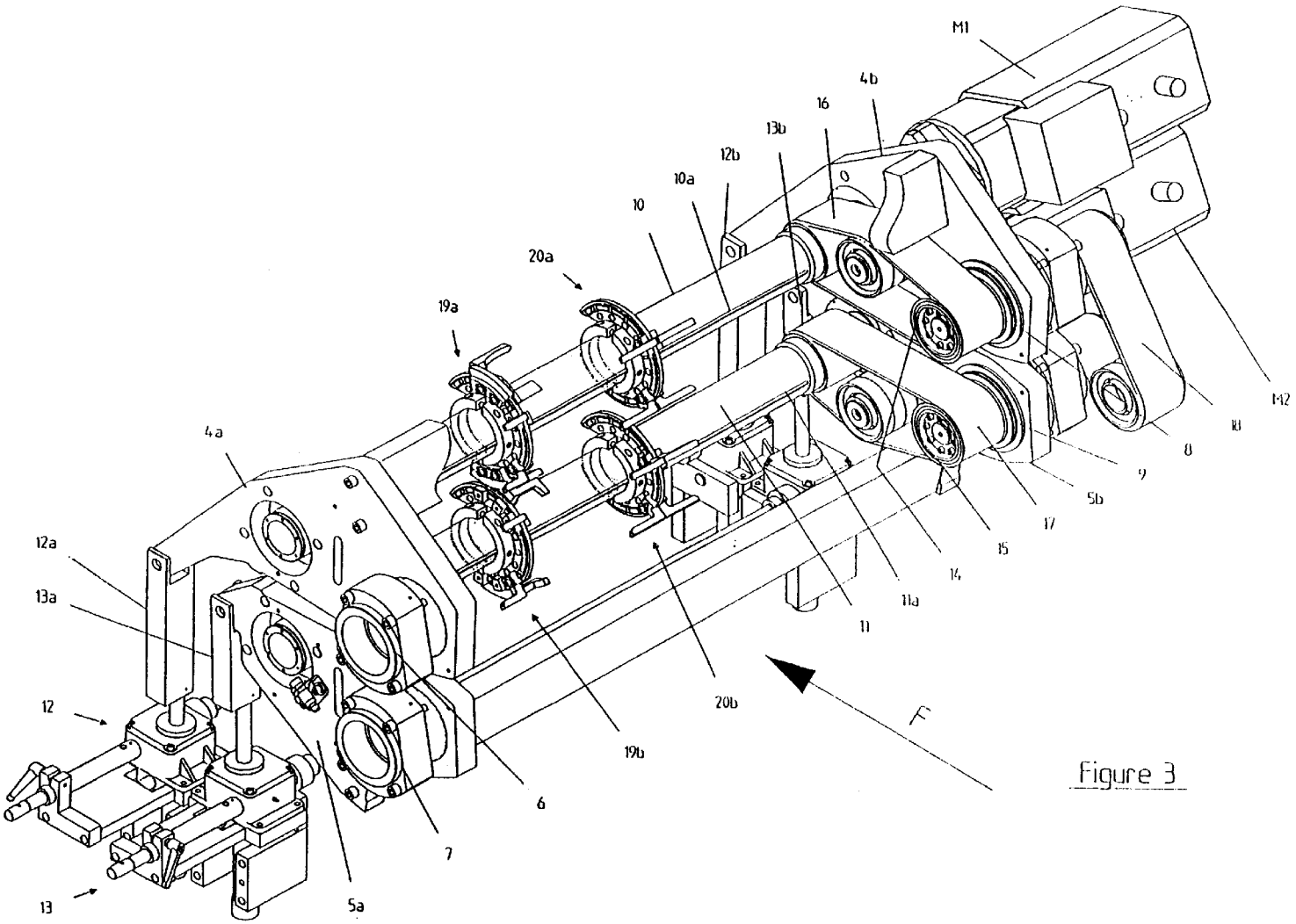
FIG. 3 is a perspective view of a detail in FIG. 1, referring to the actual mechanism for breaking the nicks.

Once the diameters of the tool supports are chosen, the various tools 27 are positioned angularly fixing them by means of nuts 29 and bolts 30. Then, the position of the cradles 4*a,* 4*b,* 5*a,* 5*b* is adjusted with respect to the horizontal path of the blanks moved by the conveyor 30, 31*a,* 31*b,* by means of adjusting devices 12, 13 (FIG. 3 ). This adjustment allows to accurately and simultaneously adjust the depth penetration of all tools 27. This represents a saving of time since it is not necessary to adjust tool by tool.

The following operation consists in positioning and fixing the annular tool supports 19*a,* 19*b,* 20*a,* 20*b* on the tool holder shafts 10, 11. These annular tool supports 19*a,* 19*b,* 20*a,* 20*b,* are laterally introduced owing to the angular openings of the discoidal rings 21 in the form of circular sectors, forming these tool supports. Accurate angular positioning is ensured owing to the internal groove 22*a* of the half clamping collar 22 which can be engaged by means of a key (not shown) in the keyslots 10*a,* 11*a* of the tool holder shafts 10, respectively 11. Then, and before tightening both half clamping collars 22, 23 by the screws 24, 25, the tool supports 19*a,* 19*b,* 20*a,* 20*b* are longitudinally positioned along the tool holder shafts 10, 11.

It can happen that the axial position of one or the other pair of tool supports 19*a,* 19*b,* 20*a,* 20*b* on the tool holder shafts 10, 11, interferes with the conveying mechanism. This problem is solved owing to the device according to the present invention, since the upper parts 31*a,* 31*b* of this conveyor can be spaced from one another to allow the passage of one of the upper tool supports 19*a,* 20*a,* whereas the loop 32*a* formed by the guide rollers 33*a* under the lower part 30 of the conveyor can open to let pass one of the lower tool supports 19*b,* 20*b.*

To carry out this modification of the conveying mechanism, it is first necessary to remove the two removable supports 36 carrying the rollers 33*b,* on the lower part 30 and the two removable supports 42 each carrying a bogie 40. Then, by sliding motion, the slide 35 of the lower part 30, and the slides 41 of the upper parts 31*a,* 31*b,* must be spaced from one another. The idler rollers 33*c* thus allow to maintain the endless conveying belts 32, 38*a,* 38*b* tight. When useful information, particularly about blank sizes, is introduced into the microprocessor 45, the described device is ready to operate.

It can be noted from this description that the device according to the invention can be adapted to a range of sizes and types of cardboard blanks extremely broad and that the adjustment operations are simple to carry out. This device not only allows to position the tools 27 angularly and longitudinally (or transversely if referred to the travelling direction F of the blanks), but also to change the diameters of the tool supports 19*a,* 19*b,* 20*a,* 20*b* in order to adapt to blanks of different sizes. The possibility of spacing the conveying belts 32, 38*a,* 38*b* for positioning the tool supports 19*a,* 19*b,* 20*a,* 20*b* in any axial position along the tool holder shafts 10, 11, according to the location of the cutting lines on the blanks, enables to work over the entire width of the blanks.

The detection of the front edges of the blanks by the cell 44 and the adjustment of the angular position of the tools 27 by the microprocessor 45 allow a greater flexibility and a saving of the time required for the adjustment, since the spacing between the blanks can vary. The angular adjustment of the tools 27 according to variable spacings of the cardboard blanks leads to a productivity gain, since the number of blanks processed per unit of length by the device according to the present invention can be increased.

What is claimed is:

1. A device for breaking nicks connecting two edges of a previously cut line on a cardboard blank, the device comprising:

a frame;

a conveyor supported by the frame for conveying cardboard blanks along a path that is substantially planar;

first and second parallel shafts rotatably mounted to the frame and disposed on both sides of the substantially planar path of the blanks;

first and second annular tool supports respectively disposed on the first and second shafts;

a mechanism operative to move the tool supports both rotatively and linearly on the first and second shafts to position the tool supports both angularly and longitudinally on the respective shafts;

first and second shearing tools respectively supported on the tool supports the first and second shearing tools being configured and positionable to cut through all uncut portions of the cardboard blanks which pass between them; and a respective synchronous drive motor connected to each of the shafts for driving the shafts to rotate, and the shafts being connected to each other by a connection; one of the motors being a main motor and the other motor being controlled by the main motors, whereby the shearing tools are rotatable with the respective shafts; and a drive mechanism for rotating the shafts and the tools thereon.

2. The device of claim 1, wherein each of the tool supports includes an annular positioning projection for positioning the tool support on the respective shaft.

3. The device of claim 1, wherein each of the tool supports comprises:

a discoidal ring in the form of a sector of a circle and having an angular opening through the ring for passage therethrough of a respective one of the shafts for enabling each tool support to be mounted on the respective shaft;

a first half clamping collar having a diameter corresponding to the diameter of the tool head of the shaft and being fixedly attached to each of the discoidal rings;

a second half clamping collar having the same diameter as the first half clamping collar; and a closing mechanism for tightening the first and second half clamping collars together.

4. The device of claim 1, further comprising: first and second cradles spaced apart along the length of and supporting the first shaft; and third and fourth cradles spaced apart along the length of and supporting the second shaft, the cradles being connected to the frame for connecting the shafts of the frame; each cradle being pivotally mounted on the frame around an axis parallel to the shafts, so that the cradles and the shafts thereby supported can occupy a selected one of a plurality of pivot positions with respect to the planar path of the cardboard blanks, and enabling the parallel shafts to receive annular tool supports of differing diameters.

5. The device of claim 4, wherein the tool supports each have a diameter corresponding to a multiple length of the cardboard blanks that are conveyed along the conveyor in the travel direction on the path of the blanks through the device plus a predetermined spacing between successive cardboard blanks moving along the conveyor.

6. The device of claim 1, further comprising:

a detector for detecting the passage of a leading front end of a cardboard blank as is passes a predetermined point along the path of the blank; and a speed controller for the main motor responsive to detection of the front edge of the blank so that the angular rotative position of the tools supported will coincide with the position of the nicks on the blank to be broken.

7. The device of claim 1, wherein the conveyor for the blanks comprises:

upper belts above the blanks and lower belts below the blanks, the belts being moveable for conveying the belts in a conveying direction;

the conveyor belts above and below the blanks being divided in two with the parts of the belts being on both sides of a plane defined by a respective axis of rotation of each of the two holder shafts; and respective supports for each part of the conveyor belt located at each side of and adjacent to the plane through the holder shaft axes; the respective supports for each part of the conveyor belts being movable parallel to the path of the blanks to allow spacing of each of the conveyor belt parts to be adjusted adjacent to the plane through the axes of rotation of the shafts and thereby enabling positioning of the tool supports between the conveyor belt parts.

8. The device of claim 1, wherein the shafts are connected to rotate synchronously and further including a motor for driving the shafts.

9. The device of claim 1, wherein each of the tool supports comprises a discoidal ring in the form of a sector of a circle and having an angular opening through the ring for passage therethrough of a respective one of the shafts for enabling each respective tool support to be mounted on the shaft.

10. The device of claim 1, wherein the tool supports are constructed and configured to support the respective first and second shearing tools at a fixed separation distance from each other, independent of the angular positions of the tool supports relative to the shafts on which they are supported.

* * * * *